United States Patent [19]

Hayes

[11] 4,377,282

[45] Mar. 22, 1983

[54] WRIST ACTIVATOR

[76] Inventor: Thomas J. Hayes, 11 W. 17th St., New York, N.Y. 10011

[21] Appl. No.: 215,498

[22] Filed: Dec. 11, 1980

[51] Int. Cl.[3] ..... A63B 23/00

[52] U.S. Cl. ..... 272/124; 272/128

[58] Field of Search ..... 272/67, 68, 117, 128, 272/124, 119, 122; 273/67 B, 67 R, 54 B, 189 R, 26 C, 26 D, 26 R, 67 D, 67 DB, 67 DC, 193 A

[56] References Cited

U.S. PATENT DOCUMENTS

| | | | |
|---|---|---|---|
| 1,523,900 | 1/1925 | Rittenhouse | 273/67 B |
| 1,658,108 | 2/1928 | Vaughn | 272/67 |
| 2,396,106 | 3/1946 | Kusznir | 272/67 |
| 2,850,748 | 9/1958 | Read | 272/67 X |
| 3,445,109 | 5/1969 | Kolbel | 272/67 X |
| 3,497,214 | 2/1970 | Kusznir | 272/67 |
| 3,518,024 | 6/1970 | Wilson | 273/67 R |
| 3,874,660 | 4/1975 | Brethen | 272/124 |
| 4,039,183 | 8/1977 | Sakurada | 272/67 |
| 4,109,908 | 8/1978 | Pugh | 272/119 |
| 4,327,908 | 5/1982 | James | 272/119 |

FOREIGN PATENT DOCUMENTS

| | | | |
|---|---|---|---|
| 503931 | 3/1920 | France | 272/124 |
| 622320 | 4/1949 | United Kingdom | 272/124 |

*Primary Examiner*—Richard J. Johnson

*Attorney, Agent, or Firm*—Kenyon & Kenyon

[57] ABSTRACT

A wrist exercise apparatus, particularly adapted for use by an athlete such as a baseball pitcher, is disclosed. The exercise apparatus has a weighted, elongated, rectangular frame which is adapted to be grasped by the pitcher and moved in a simulated pitching motion. The frame includes side members, a weighted cross member displaced to one side of the plane in which the frame lies at one end, a wrist-backing cross member at the other end, and a transverse hand grip intermediate the two ends which is longitudinally adjustable to accommodate variations in the length of the user's hand.

3 Claims, 6 Drawing Figures

WRIST ACTIVATOR

BACKGROUND OF THE INVENTION

The present invention relates to an apparatus for exercising the wrist. More particularly, it relates to an apparatus for use in exercising the throwing wrist of an athlete, such as a baseball player.

For many sports, exercises and specialized apparatus have been developed which assist the athlete to develop certain muscles and coordination best adapted to performance of a particular sport. Thus rowing machines are available for exercising the oarsman on dry land and a variety of exercises using weights which are manipulated or which move on the end of systems of ropes and pullies, are available for muscle development. Motor powered exercisers for performing such functions are also known. However, a need exists for an apparatus which is particularly addressed to the development of those muscles in the forearm which are used by a pitcher when he snaps his wrist immediately prior to and during release of a ball.

SUMMARY OF THE INVENTION

The above object, and others which will become clear to those skilled in the art from the below appended description are met in the present invention by means of a wrist exercise apparatus, hereinafter called an activator, having a weighted elongate rectangular frame which is adapted to be grasped by the pitcher and moved in a simulated pitching motion. The frame includes side members, a weighted cross member at one end, a wrist-backing cross member at the other end, and a longitudinally adjustable transverse finger bar intermediate the two ends. The center of gravity of the weighted end is displaced to one side of the plane in which the elongate frame lies. The position of the adjustable finger bar may be moved towards or away from the wrist-backing member being fastened by means of removable pins, to accommodate variation in the length of the user's hand.

To exercise the wrist, the pitcher's hand is passed into the space between the finger bar and the wrist bar so that the wrist bar comes to rest on the back of the wrist. The spacing between the finger bar and the wrist bar is adjusted and set so that, when the finger bar is gripped by the same fingers of the pitcher's hand as would be used to grip a baseball, the wrist bar rests on the bumps where the bones of the hand and of the forearm are joined, lying on top of the superficial ligaments forming part of the joint. With the fingers grasping the bar, the wrist activator is swung back low, past the pitcher's side, and then brought up, over, and forward, duplicating the actual pitching motion as though a baseball were being pitched without, however, releasing the activator. The exercise is repeated as needed.

DETAILED DESCRIPTION OF THE INVENTION

Figure 1:
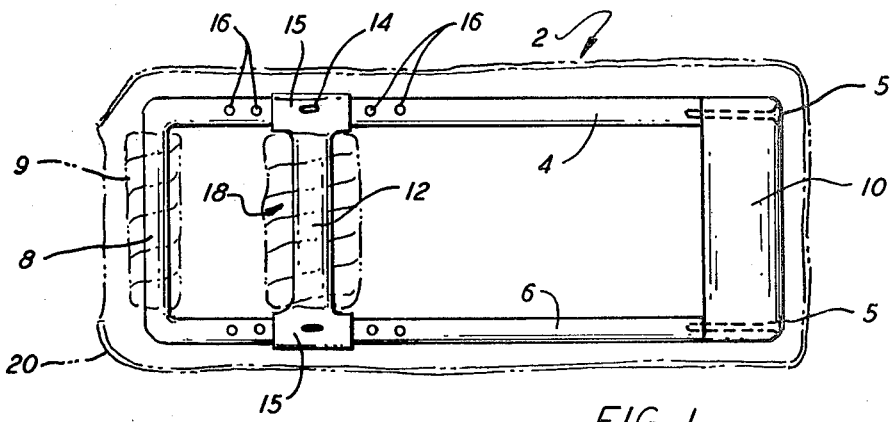
FIG. 1 is a plan view of a wrist activator in accordance with the teachings of the invention.
Figure 2:
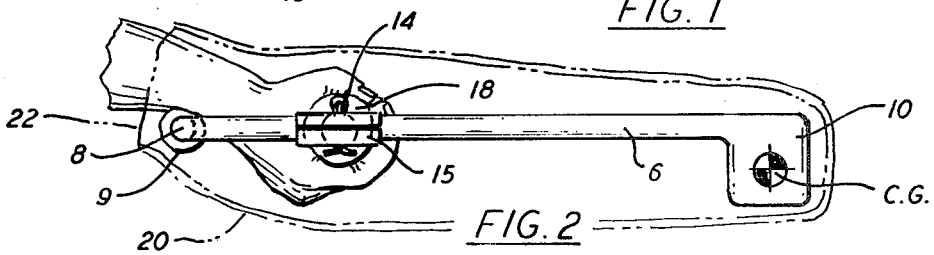
FIG. 2 is a side view of the activator of FIG. 1.

FIGS. 1 and 2 are plan and side views of a wrist exerciser or activator fabricated in accordance with the teachings of the invention.

The apparatus comprises a rectangular frame 2 having elongate sidebar members 4 and 6 and cross, end members 8 and 10. The frame may be made of bar stock, bent into a U-shape, with the bottom of the U forming cross bar 8 and being rounded to prevent damage to the user's wrist on forcible contact. A sponge rubber pad 9 is wrapped around cross bar 8 to further protect the user's wrist. The other end of the frame is cross bar 10 which takes the form of a weight and may conveniently be fastened between side members 4 and 6 of the frame by means of screws 5. As best seen in FIG. 2, the center of gravity, marked c.g., is displaced from the plane of the frame. A finger grip 12, takes the form of a cross bar which is fastened between side bars 4 and 6 and which is longitudinally adjustable thereon. The position of finger grip 12 may be set by means of pins 14 which pass through holes in sleeves 15 on either end of cross bar 12 into cooperating holes 16 in sidebars 4 and 6. A padded sleeve 18, shown in phantom by the dashed lines in FIG. 1 and shown in solid lines in an end view in FIG. 2, surrounds finger bar 12 and provides a comfortable surface and body for gripping by the fingers.

The frame 2 is made of a convenient metal, such as steel or aluminum, and has an overall length of, preferably, about 17 inches, and a width on the order of 6½ inches. The latter dimension is chosen to insure comfortable access to the padded finger grip by the full hand of the user. In a typical application, the spacing between finger grip 12 and end bar 8 will be about 4½ inches. It will be understood that, as to the width and the spacing, the dimensions are not particularly critical, but are provided to accommodate a wide range of hand sizes. The amount of weight used in counterweight 10 will vary according to the age and strength of the user. It may range from 1½ to about 6 pounds.

A protective sleeve or shroud 20 having an opening 22 for passage of the hand can be placed around the apparatus.

Figure 3:
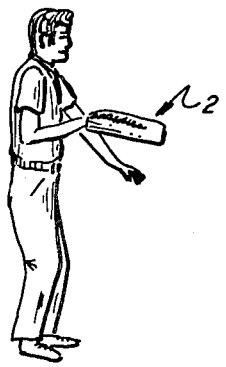
FIGS. 3–6 are views, in perspective, of the invention in use, showing successive positions of the pitcher's arm while using a wrist activator in accordance with the teachings of the invention.
Figure 4:
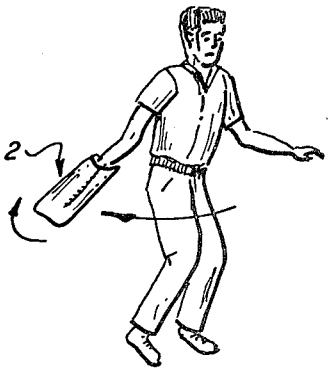
Figure 5:
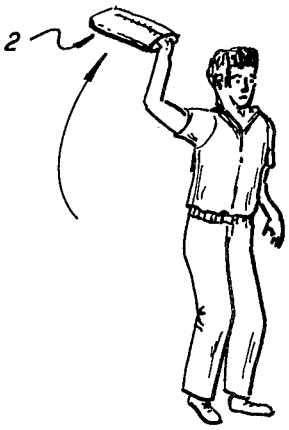
Figure 6:
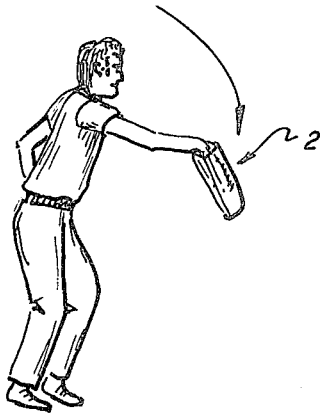

In use, the fingers of the user are inserted into the space between end bar 8, the index and second fingers being then caused to grip the finger bar, as shown in FIG. 2. The user then prepares his back swing as shown in FIG. 3, and swings the arm back past the hip (FIG. 4) and up behind, bringing the wrist and the exerciser forward over the shoulder as shown in FIG. 3. Follow-through is forward and down (FIG. 4). The exercise obtained by going through and repeating this motion develops the grip of the fingers on the baseball as well as the muscles of the hand, wrist and arm which are used in preparing and delivering a pitch. The effect of placing counterweight 10 out of the plane of the frame tends to prevent turning of the hand during the pitching motion.

A simple series of twenty pitching movements performed with the apparatus of the invention has an immediate, noticeable effect; immediately after such exercise, a pitcher finds that he delivers the ball lower and faster. The device is particularly useful because it restores wrist flick for veteran pitchers.

While the invention has been described in a particular, simple, configuration, it will be apparent to those skilled in the art that other configurations may be employed without departing from the teachings of the invention. The below appended claims should, therefore, be given an interpretation in keeping with the spirit of the invention, rather than limited to the literal detail described herein.

What is claimed is:

1. An apparatus for use in exercising the wrist, particularly for pitching, comprising a rigid elongate frame having a weight at one end, a transverse wrist bar at the other end, a hand grip fastened intermediate the wrist bar and the weight, said wrist bar and hand grip defining a plane and the center of gravity of the weight lying outside of the plane, and means for adjusting the spacing between the hand grip and the wrist bar to fit the hand of the user.

2. The apparatus of claim 1 further comprising the surface of the wrist bar being comfortably rounded and the hand grip having a padded surface.

3. The apparatus of claim 1 wherein the spacing between the finger bar and the wrist bar is adjusted so that said wrist bar rests on top of the superficial ligaments forming part of the joint where the bones of the hand and forearm are joined.

* * * * *